US012623815B2

(12) United States Patent
Tatu et al.

(10) Patent No.: US 12,623,815 B2
(45) Date of Patent: May 12, 2026

(54) SQUEEZABLE TUBE DISPENSER

(71) Applicant: Colgate-Palmolive Company, New York, NY (US)

(72) Inventors: Francis Tatu, Sea Girt, NJ (US); Mark Bartlett, North East, PA (US)

(73) Assignee: Colgate-Palmolive Company, New York, NY (US)

( * ) Notice: Subject to any disclaimer, the term of this patent is extended or adjusted under 35 U.S.C. 154(b) by 186 days.

(21) Appl. No.: 18/552,085

(22) PCT Filed: Feb. 4, 2022

(86) PCT No.: PCT/US2022/015211
§ 371 (c)(1),
(2) Date: Sep. 22, 2023

(87) PCT Pub. No.: WO2022/203766
PCT Pub. Date: Sep. 29, 2022

(65) Prior Publication Data

US 2024/0166409 A1 May 23, 2024

Related U.S. Application Data

(60) Provisional application No. 63/165,855, filed on Mar. 25, 2021.

(51) Int. Cl.
*B65D 35/10* (2006.01)
*B65D 41/02* (2006.01)
(Continued)

(52) U.S. Cl.
CPC ..... *B65D 35/10* (2013.01); *B65D 41/02* (2013.01); *B65D 41/18* (2013.01); *B65D 65/466* (2013.01)

(58) Field of Classification Search
CPC ..... B65D 35/10; B65D 41/18; B65D 65/466; B65D 41/02
See application file for complete search history.

(56) References Cited

U.S. PATENT DOCUMENTS 4,574,987 A 3/1986 Halligan et al.
4,813,862 A 3/1989 Bowers et al.
(Continued)

FOREIGN PATENT DOCUMENTS

EP 1035025 9/2000
EP 1495985 1/2005
(Continued)

OTHER PUBLICATIONS

International Search Report and the Written Opinion of the International Searching Authority issued in International Application PCT/US2022/015211 mailed Apr. 25, 2022.
(Continued)

*Primary Examiner* — Frederick C Nicolas

(57) ABSTRACT

A squeezable tube dispenser including a body, a nozzle, and a closure component. The body has an interior cavity for containing a substance. The nozzle is coupled to the body adjacent to an open top end of the body. The closure component includes a cover member that defines a cover cavity and a cap member protruding from an inner surface of the cover member into the cover cavity. The cap member defines a cap cavity. The cap member is detachably coupled to the nozzle via a friction fit with the nozzle nesting within the cap cavity of the cap member. The body and the cover member of the closure component are formed predominantly from a fibrous material and the nozzle and the cap of the closure component are formed from a plastic material. The squeezable tube dispenser has no more than 15% by weight of plastic.

19 Claims, 7 Drawing Sheets

(51) Int. Cl.

| | |
|---|---|
| ***B65D 41/18*** | (2006.01) |
| ***B65D 41/48*** | (2006.01) |
| ***B65D 65/46*** | (2006.01) |

(56) References Cited

U.S. PATENT DOCUMENTS

| | | | | |
|---|---|---|---|---|
| 5,060,827 | A | 10/1991 | Segati | |
| 5,217,164 | A | 6/1993 | Sullivan | |
| 6,302,300 | B1 | 10/2001 | Boesch | |
| 7,048,975 | B1 | 5/2006 | Tojo et al. | |
| 7,344,784 | B2 | 3/2008 | Hodson | |
| 7,819,251 | B2 | 10/2010 | West et al. | |
| 8,771,813 | B2 * | 7/2014 | West | B32B 29/005 428/34.3 |
| 9,452,863 | B2 | 9/2016 | Dayton et al. | |
| 9,714,124 | B2 * | 7/2017 | Johnson | B67D 7/0294 |
| 10,399,747 | B2 | 9/2019 | Ahmed | |
| 10,526,120 | B2 | 1/2020 | Berk et al. | |
| 2006/0113318 | A1 | 6/2006 | May et al. | |
| 2007/0131713 | A1 | 6/2007 | Hill | |
| 2012/0111368 | A1 | 5/2012 | Rahimy et al. | |

FOREIGN PATENT DOCUMENTS

| | | |
|---|---|---|
| JP | 2021-041934 | 3/2021 |
| KR | 102225755 | 3/2021 |
| WO | 2011/034998 | 3/2011 |
| WO | 2020/016409 | 1/2020 |

OTHER PUBLICATIONS

Zhang, Qi, 1980, "Introduction to Sealing Linings for Packaging," Southwest Paper, 02, published Dec. 31, 1980, pp. 42-46.

Wang, X. et al., "Packaging Materials of Cosmetics and Safety Thereof," (2018), Plastic Packaging, published Aug. 15, 2018, vol. 28, No. 4, pp. 9-15.

* cited by examiner

SQUEEZABLE TUBE DISPENSER

CROSS-REFERENCE TO RELATED APPLICATIONS

The present application claims priority to U.S. Provisional Patent Application Ser. No. 63/165,855, filed Mar. 25, 2021, the entirety of which is incorporated herein by reference.

BACKGROUND

Plastic packaging is commonly used for many products including solid, semi-solid, paste, and liquid items such as food, beverages, water, consumer products, lotions, medicines, wet chemicals, and the like. These plastic packaged products generate waste in the form of plastics and its derivatives, and where non-biodegradable materials are used for this ever-increasing packaging, it may result in contamination of the landscape and the environment. In addition, some of these plastics may leach various toxic substances into the products that they enclose, endangering the safety and health of the consumers of such products.

Paper containers are sometimes used instead to package dry goods and liquids. While paper is typically biodegradable, paper poses other difficulties when used as a liquid packaging material. Paper containers are typically compound structures formed of multiple flat paper sections. These assemblies have multiple seams and other potential weak points that may rupture or otherwise leak as liquids find their way into voids left by imperfect manufacture or wick into the cut edges of the coated paper where it is exposed on the inside surfaces of the container. These paper containers may also include additional materials such as plastic films or composite sheets that are not biodegradable and which may render the paper containers unable to be disposed in the paper waste stream, which has requirements for weight percentages of plastic that may be present. Thus, there remains a need for a biodegradable and/or recyclable container that may be used for the storage, transport, and/or dispensing of solid, semi-solid, paste, and/or liquid items.

BRIEF SUMMARY

The present invention is directed to a squeezable tube dispenser including a body, a nozzle, and a closure component. The body has an interior cavity for containing a substance. The nozzle is coupled to the body adjacent to an open top end of the body. The closure component includes a cover member that defines a cover cavity and a cap member protruding from an inner surface of the cover member into the cover cavity. The cap member defines a cap cavity. The cap member is detachably coupled to the nozzle via a friction fit with the nozzle nesting within the cap cavity of the cap member. The body and the cover member of the closure component are formed predominantly from a fibrous material and the nozzle and the cap of the closure component are formed from a plastic material. The squeezable tube dispenser has no more than 15% by weight of plastic.

In one aspect, the invention may be a squeezable tube dispenser comprising: a body comprising an interior cavity for containing a substance, a sealed bottom end, and an open top end; a nozzle coupled to the body adjacent to the open top end of the body, the nozzle defining a passageway into the internal cavity; and a closure component comprising: a cover member having a top portion and a sidewall portion, an inner surface of the top portion and an inner surface of the sidewall portion defining a cover cavity; and a cap member coupled to the inner surface of the top portion of the cover member and protruding downwardly therefrom into the cover cavity, the cap member comprising an inner surface that defines a cap cavity; wherein the cap member of the closure component is detachably coupled to the nozzle via a friction fit with the nozzle nesting within the cap cavity of the cap member; and wherein the body and the cover member of the closure component are formed predominantly from a fibrous material and the nozzle and the cap of the closure component are formed from a plastic material, and wherein the squeezable tube dispenser comprises no more than 15% by weight of plastic.

In another aspect, the invention may be a squeezable tube dispenser comprising: a body comprising an interior cavity for containing a substance; a nozzle coupled to the body and defining a passageway into the internal cavity through which the substance is configured to be dispensed; and a closure component comprising: a cover member defining a cover cavity; and a cap member coupled to the cover member and protruding into the cover cavity, the cap member comprising an inner surface that defines a cap cavity; wherein the cap member and the nozzle have tapered sidewalls so that the cap member is detachably coupled to the nozzle via a Luer-slip connection with the nozzle nesting within the cap cavity of the cap member; and wherein the body and the cover member are formed predominantly from a fibrous material and the nozzle and the cap are formed from a plastic material, and wherein the squeezable tube dispenser comprises no more than 15% by weight of plastic.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
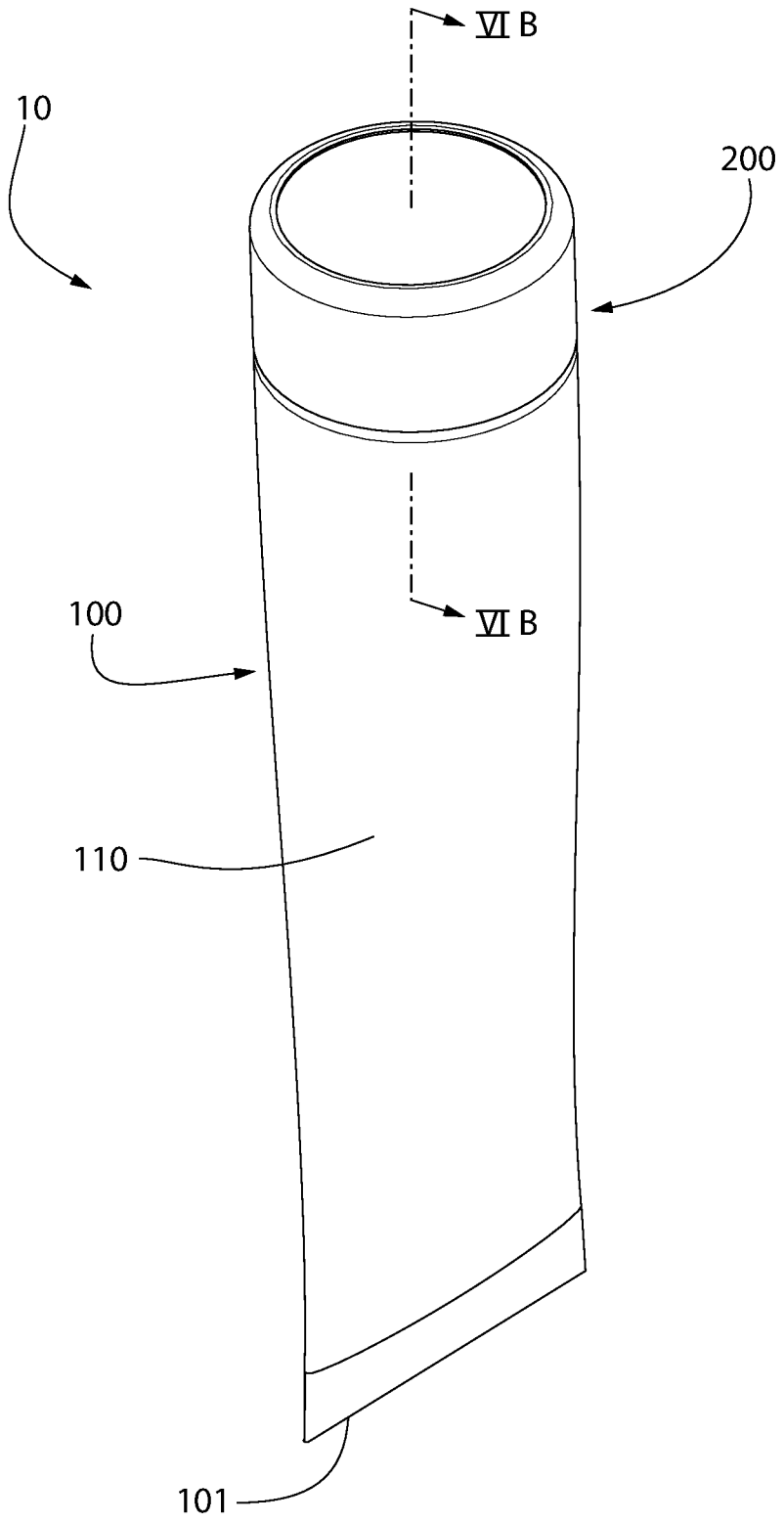
FIG. 1 is a top perspective view of a squeezable tube dispenser in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower." "upper." "horizontal," "vertical," "above," "below," "up," "down," "top" and "bottom" as well as derivatives thereof (e.g., "horizontally." "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used herein the term "fibrous material" refers to a material that is formed by or characterized by a plurality of discrete fibers. The filaments of such fibers can be plant or animal derived, synthetic, or some combination of these. In plant-derived fibrous materials the filaments are at least predominantly of plant origin, examples of which include wood, papyrus, rice, ficus, mulberry, fibers, cotton, yucca, sisal, bowstring hemp and New Zealand flax. Paper is a fibrous material that is usually made by pressing and dewatering moist fibers, typically cellulose pulp derived from wood, rags, or grasses. In preferred embodiments, the fibrous materials of the tube body and the cover member have substantially the same chemical composition. The body and the cover member are preferably made of any suitable fibrous material, preferably biodegradable materials comprising paper, cardboard, or fiberboard. The term "fibrous material" specifically excludes plastic and metal, and is intended to refer to paper-based materials or cellulosic materials formed from plant fibers or the like as noted above.

Figure 2:
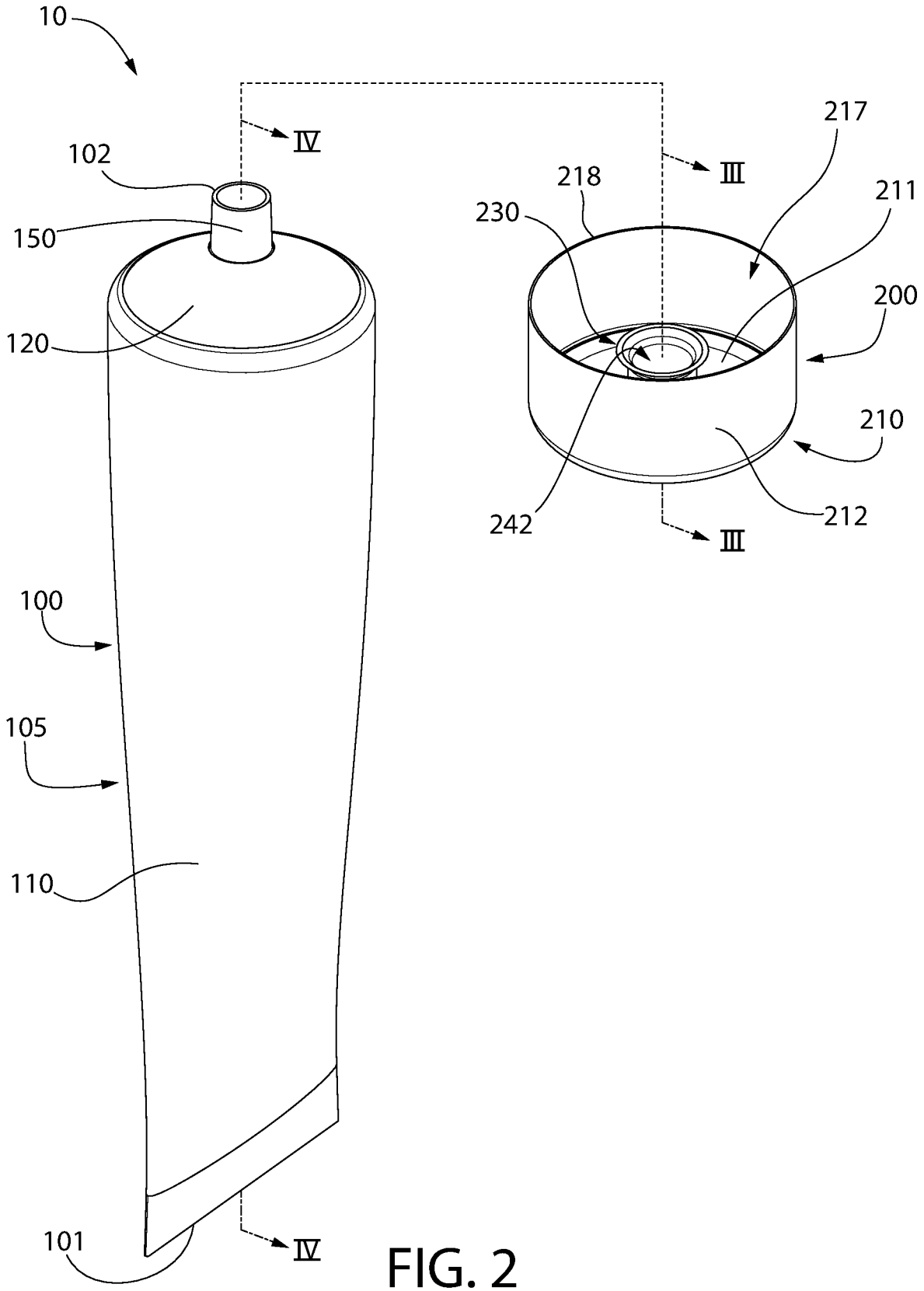
FIG. 2 is a top perspective view of the squeezable tube dispenser of FIG. 1 with a closure component thereof detached from a body and nozzle thereof.

Referring first to FIGS. 1 and 2, a squeezable tube dispenser 10 is illustrated in accordance with an exemplified embodiment of the present invention. The squeezable tube dispenser 10 generally comprises a tube assembly 100 and a closure component 200. The closure component 200 is detachably coupled to the tube assembly 100 between an attached state shown in FIG. 1 and a detached state shown in FIG. 2. In the attached state, any substance held by or contained within the tube assembly 100 will not be dispensed therefrom. In the detached state, upon a squeezing force being applied onto the tube assembly 100, the substance contained therein will be dispensed therefrom. That is, in the exemplified embodiment, a user can apply g squeezing force onto the tube assembly 100 to cause a main body portion of the tube assembly 100 to compress, which results in dispensing of the contents. In alternative embodiments, the dispenser 10 may include an actuation mechanism for purposes of dispensing in situations where the tube assembly cannot be squeezed/compressed. Such an actuation mechanism may include a pump, a rotatable actuator that moves a platform/elevator up and down, or the like.

The tube assembly 100 comprises a bottom end 101 and a top end 102. The bottom end 101 of the tube assembly 100 is sealed and the top end 102 of the tube assembly 100 is open for dispensing of the substance contained therein. The bottom end 101 of the tube assembly 100 may be sealed in various ways, including cinching, welding, adhesives, fasteners, or the like. The bottom end 101 of the tube assembly 100 is preferably hermetically sealed to prevent the substance contained in the tube assembly 100 from leaking or otherwise being dispensed from the bottom end 101. The tube assembly 100 may be configured to be rolled upward from the bottom end 101 to assist with the dispensing process. In the exemplified embodiment, with the closure component 200 in the detached state, a squeezing action on the tube assembly 100 will result in the substance being dispensed from the top end 102 of the tube assembly 100 and not also from the bottom end 101 of the tube assembly 100 due to the bottom end 101 being sealed closed.

Figure 4:
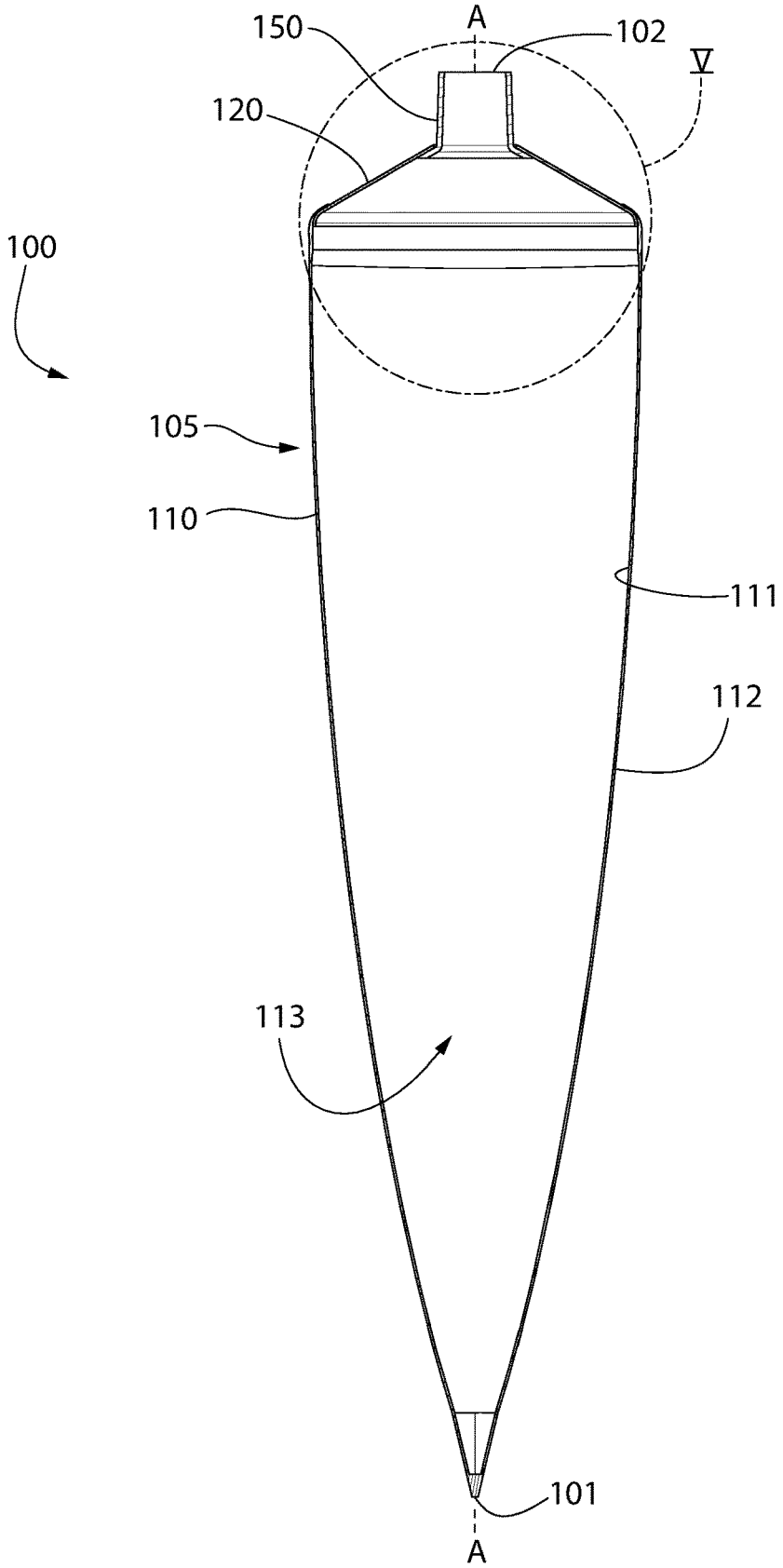
FIG. 4 is a cross-sectional view of the body and nozzle taken along line IV-IV of FIG. 2.

Referring to FIGS. 2 and 4, the tube assembly 100 is formed from several distinct components or parts that are coupled together. Specifically, the tube assembly 100 comprises a body 105 that is configured to contain a substance and a nozzle 150 through which the substances passes when being dispensed. In the exemplified embodiment the body 105 comprises a main body component 110 and a shoulder component 120 that are coupled together. However, in other embodiments it may be possible for the body 105 to be a single unitary part.

The body 105 comprises an inner surface 111 and an outer surface 112. The inner surface 111 of the body 105 defines an interior cavity 113 that is configured to contain a substance for dispensing from the squeezable tube dispenser 10. Although no substance is illustrated within the interior cavity 113 in the exemplified embodiment, it should be appreciated that the substance may fill the interior cavity 113 so that the same can be dispensed for use when the closure component 200 is detached from the tube assembly 100. The specific substance which is configured to be dispensed from the squeezable tube dispenser 10 may not be particularly limiting of the invention in all embodiments. The substance may be a liquid, paste, ointment, or gel in some embodiments such that squeezing the body 105 when the closure component 200 is detached from the tube assembly 100 may result in the substance being dispensed through the nozzle 150. In some embodiments, the substance may be a toothpaste that is configured to be dispensed onto a toothbrush prior to use thereof. In other embodiments, the substance may be a gel or ointment configured for application to a user's skin or oral cavity for treatment or the like. In still other embodiments, the substance may be a solid or semi-solid substance, such as a deodorant product, or the like. In the exemplified embodiment, the squeezable tube dispenser 10 may contain any substance that is capable of being dispensed through the nozzle 150 when the body 105, and more specifically the main body component 110, is squeezed (as with traditional operation of a toothpaste tube).

Figure 5:
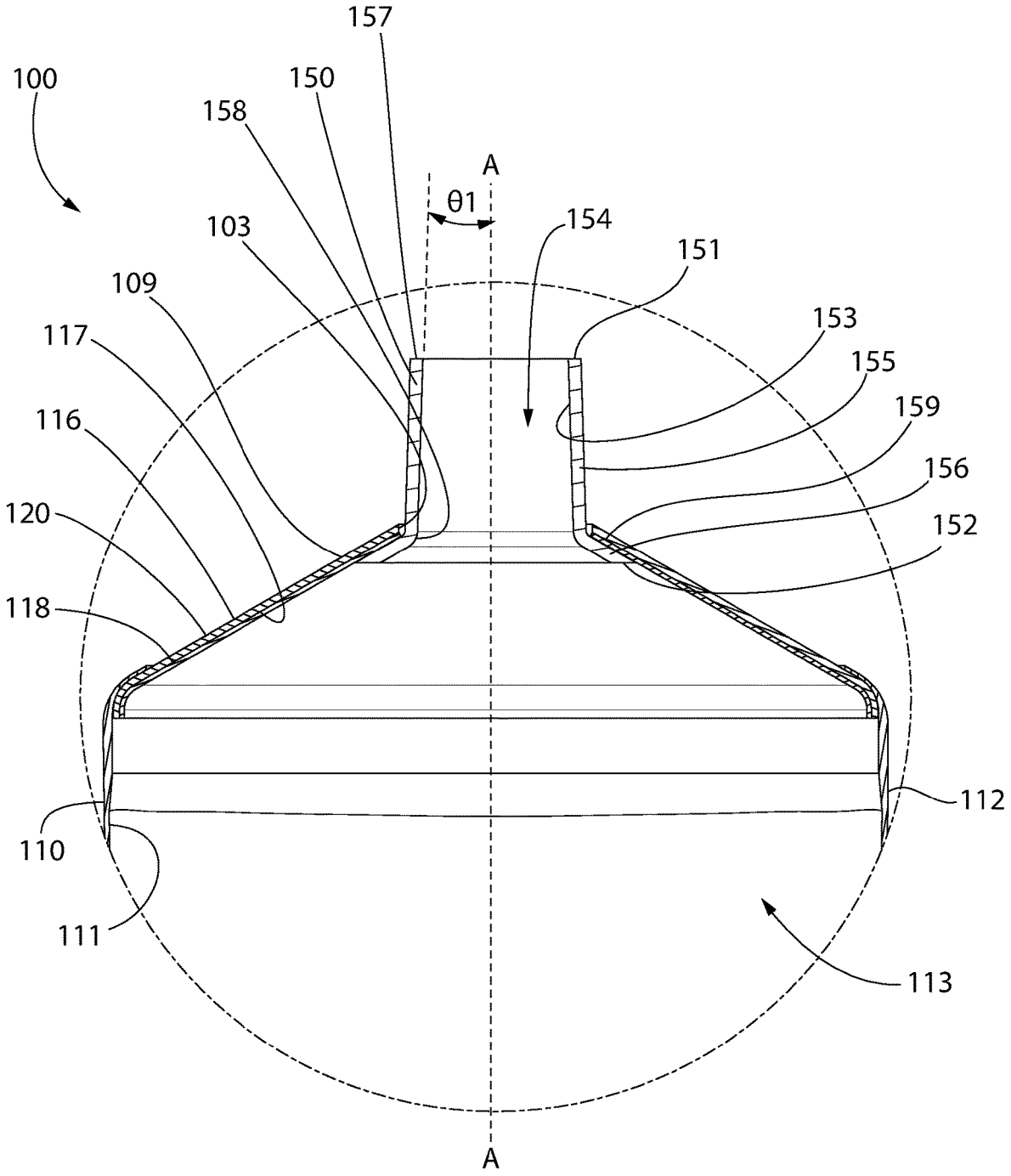
FIG. 5 is a close-up view of area V of FIG. 4.

Referring to FIGS. 4 and 5, the body 105 and nozzle 150 of the tube assembly 100 of the squeezable tube dispenser 10 will be further described. In the exemplified embodiment, the body 105 is formed predominantly from a fibrous material. Fibrous materials include cellulosic materials such as paper, paperboard, cardboard, and the like including layers of one or more of these materials as noted herein above. In the exemplified embodiment, the main body component 110 and the shoulder component 120 are separate components formed from a fibrous material. The main body component 110 and/or the shoulder component 120 may include a layer of a plastic material (such as polypropylene or polyethylene including high-density polyethylene, or the like) along the portions thereof which are coupled together to enable the main body component 110 and the shoulder component 120 to be attached using plastic welding techniques. However, the main body component 110 and the shoulder component 120 should still be formed predominantly from a fibrous material. In other embodiments, it may be possible to attach the main body component 110 and the shoulder component 120 using adhesives or fasteners. As used herein, the term predominantly means that at least 85%, more preferably at least 90%, and still more preferably at least 95% of the main body component 110 and the shoulder 120 should be formed from fibrous material in some embodiments.

The body 105 comprises the closed bottom end 101 and an open top end 103. The body 105 extends from the closed bottom end 101 to the open top end 103 along a first longitudinal axis A-A. In the exemplified embodiment, the open top end 103 is defined by an opening in the shoulder component 120 of the body 105. The nozzle 150 is coupled to the body 105 at a position that is adjacent to the open top end 103.

In particular, the nozzle 150 comprises a first end 151, a second end 152, and an inner surface 153 that defines a passageway 154 through the nozzle 150 from the first end 151 to the second end 152. Thus, the passageway 154 extends from the first end 151 of the nozzle 150 (which is located at the open top end 102 of the tube assembly 100) and into the internal cavity 113 of the body 105 to provide a pathway for dispensing of the substance within the internal cavity 113 through the nozzle 150. The nozzle 150 comprises a sidewall portion 155 and a flange portion 156 that extends from an end of the sidewall portion 155. More specifically, the sidewall portion 155 extends from a first end 157 which is the same as the first end 151 of the nozzle 150 to a second 158, and the flange portion 156 extends downwardly and outwardly from the second end 158 of the sidewall portion 155 to the second end 152 of the nozzle 150. The first end 157 of the nozzle 150 forms a distal end of the nozzle 150. The flange portion 156 extends obliquely from the sidewall portion 155 in a radially outward manner in the exemplified embodiment.

The sidewall portion 155 of the nozzle 150 is tapered as it extends from the second end 158 to the first end 157. The portion of the sidewall 155 that protrudes from the open top end 103 of the body 105 is tapered as it extends further from the open top end 103 of the body 105 toward the first end 151 of the nozzle 150. Thus, the cross-sectional area of the passageway 154 decreases the further it is away from the open top end 103 of the body 105. Each side of the sidewall portion 155 as shown in a longitudinal cross-section in FIG. 5 is therefore oriented at an angle relative to the longitudinal axis A-A. In one particular embodiment, each side of the sidewall portion 155 is oriented at a first taper angle $\Theta 1$ relative to the first longitudinal axis A-A, with the first taper angle $\Theta 1$ being approximately 1.72°. Thus, the sidewall portion 155 of the nozzle 150 has a 6% taper (a slope with rise over run percentage of 6% converted to degrees is 3.43 degrees, so each side of the sidewall portion 155 is at a 1.715° (rounded to 1.72°) angle relative to the longitudinal axis A-A. This is determined using the formula $\text{Degrees}=\text{Tan}^{-1}$ (Slope Percent/100). The sidewall portion 155 of the nozzle 150 may form a male fitting of a Luer-slip connection, as described in greater detail below.

The flange portion 156 of the nozzle 150 is the portion that is coupled to the body 105 of the tube assembly 100. Thus, the flange portion 156 of the nozzle 150 is positioned within the internal cavity 113 of the body 105 and coupled thereto. The flange portion 156 of the nozzle 150 has an outer surface 159 which faces and contacts a portion of the inner surface 111 of the body 105 along the shoulder component 120 thereof. The flange portion 156 of the nozzle 150 is oriented at the same angle relative to the first longitudinal axis A-A as is the shoulder component 120 of the body 105 to maximize the surface area of the outer surface 159 of the flange portion 156 which is in contact with the inner surface 111 of the body 105 along the shoulder component 120 to achieve a secure coupling therebetween.

The nozzle 150 is preferably formed from plastic, such as polypropylene, polyethylene including high-density polyethylene, or the like. Thus, the body 105 may comprise a layer of plastic which is exposed on the inner surface 111 which faces the internal cavity 113 for purposes of attachment to the nozzle 150.

More specifically, the body 105 comprises a top portion 109 that is adjacent to the open top end 103 of the body 105. The top portion 109 is the top-most portion of the shoulder component 120 of the body 105 of the tube assembly 100 in the exemplified embodiment. The top portion 109 of the body 105 comprises a fibrous portion 116 having an inner surface 117 that faces the internal cavity 113. The top portion 109 of the body 105 also comprises a plastic layer 118 that covers the inner surface 117 of the fibrous portion 116. The plastic layer 118 may comprise polypropylene, polyethylene, HDPE, or the like in various different embodiments. In the exemplified embodiment, an entirety of an inner surface of the shoulder component 120 is formed by the plastic layer 118. However, the invention is not to be so limited in all embodiments and in other embodiments only a top-most part of the inner surface 117 of the fibrous portion 116 of the shoulder component 120 may be covered by the plastic layer 118. In other words, it is sufficient if only the portion of the inner surface of the shoulder component 120 which is overlapped or covered by the flange portion 156 of the nozzle 150 is formed from plastic so that the flange portion 156 of the nozzle 150 can be heat welded to the shoulder component 120 of the body 105. Thus, the flange portion 156 of the nozzle 150 may be heat welded (plastic welded) and scaled to the body 150 to prevent any substance contained in the internal cavity 113 from leaking through gaps between the flange portion 156 and the inner surface of the body 105 and to create a secure coupling/attachment between the nozzle 150 and the body 105 to form the tube assembly 100.

Figure 3:
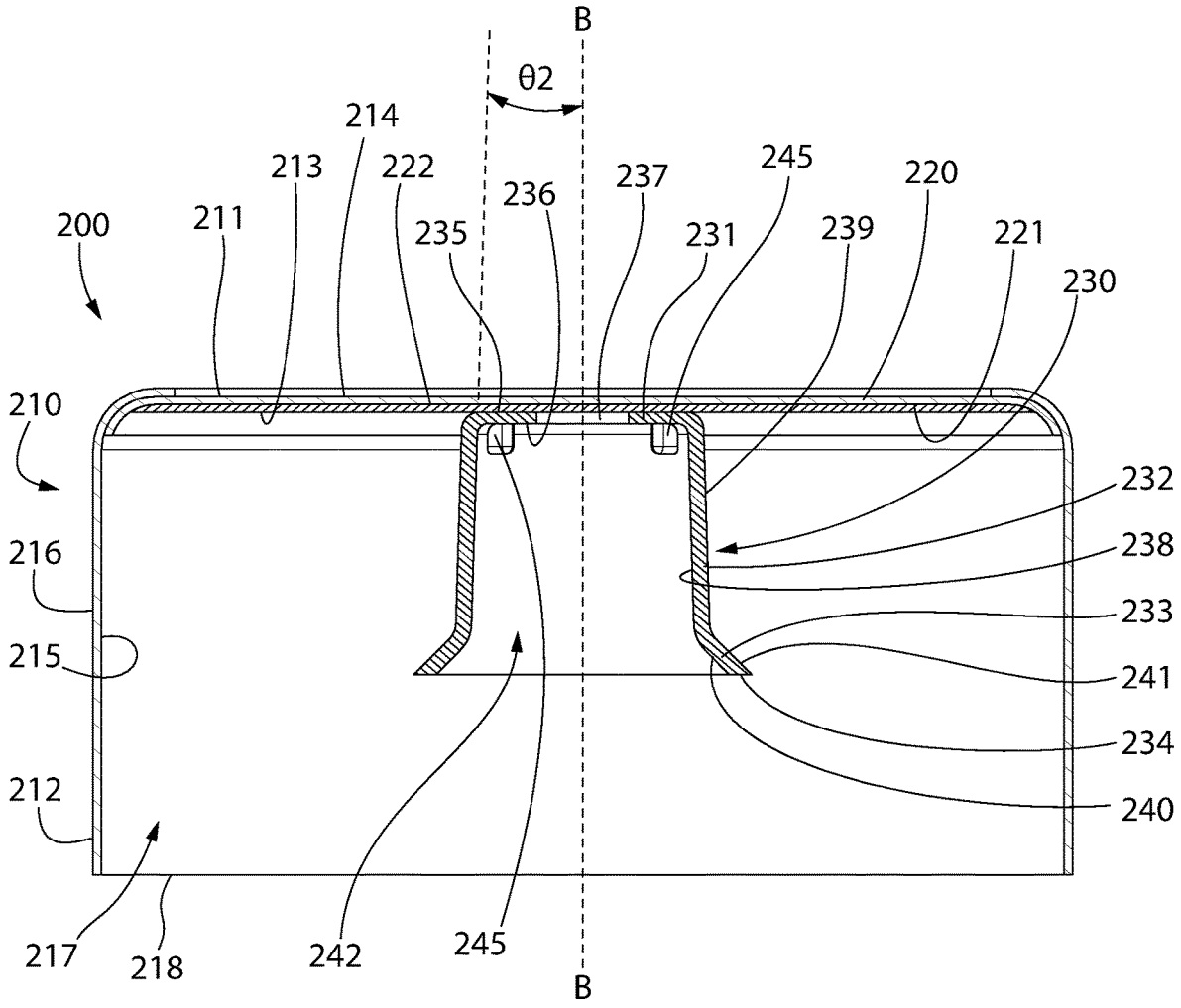
FIG. 3 is a cross-sectional view of the closure component taken along line III-III of FIG. 2.

Referring to FIGS. 2 and 3, the closure member 200 will be described. As discussed above, the closure member 200 is configured to be altered from an attached state (see FIG. 1) to a detached state (see FIG. 2) to allow for dispensing of the contents of the squeezable tube dispenser 10, and then back from the detached state to the attached state to prevent leaking and/or drying out of the contents after use. The closure component 200 comprises a cover member 210 and a cap member 230. The cover member 210 is formed from a fibrous material just like the body 105. The cap member 230 is formed from a plastic material just like the nozzle 150. When the closure member 200 is in the attached state, the cap member 230 interacts with the nozzle 150 to seal the open top end 102 of the tube assembly 100. There is no physical engagement between the cover member 210 and the tube assembly 100, although the cover member 210 may be in abutting contact with some part of the tube assembly 100, such as the main body component 110 and/or the shoulder component 120, when in the attached state.

The cover member 210 comprises a top portion 211 and a sidewall portion 212. The top portion 211 has an inner surface 213 and an outer surface 214. The sidewall portion 212 has an inner surface 215 and an outer surface 216. The inner surface 213 of the top portion 211 and the inner surface 215 of the sidewall portion 212 collectively define a cover cavity 217. Portions of the body 105 and the nozzle 150 are located within the cover cavity 217 when the closure component 200 is coupled to the tube assembly 100 as described herein. The sidewall portion 212 is coupled to the top portion 211 and extends downwardly from the top portion 211 to a distal end 218.

In the exemplified embodiment, the top portion 211 of the cover member 210 comprises a fibrous portion 220 having an inner surface 221 that faces the cover cavity 217 and a plastic layer 222 covering at least a portion of the inner surface 221 of the fibrous portion 220. In the exemplified embodiment, a substantial entirety (approximately 95%) of the inner surface 221 of the fibrous portion 220 is covered by the plastic layer 222. However, the invention is not to be so limited and the plastic layer 222 may be positioned only along a center part of the top portion 211 where the cap member 230 is attached. Thus, in some embodiments a portion of the inner surface 221 of the fibrous portion 220 is covered by the plastic layer 222. In other embodiments, the plastic layer 222 may cover the entirety of the inner surface 221 of the fibrous portion 220.

In the exemplified embodiment, the top portion 211 and the sidewall portion 212 are separate parts that are attached together, by adhesives like glue, or using other connection techniques or materials. The top portion 211 is a generally planar part that is curled or curved downwardly along its periphery. The sidewall portion 212 is an annular part comprising an upstanding annular wall that is curved inwardly along its top end. The top portion 211 is attached to the sidewall portion 212 by inserting the top portion 211 through an opening along the distal end 218 of the sidewall portion 212 until the curved periphery of the top portion 211 abuts against the curved top end of the sidewall portion 212. An adhesive may be deposited onto at least one of the inner surface of the sidewall portion 212 along the curved top end or the outer surface of the top portion 221 along the curved periphery may so that upon placing the two parts into abutting contact, they will stick together and form the cover member 210 of the closure component 200. The cover member 210 may be formed as a single, integral part in some embodiments as well.

The cap member 230 is a plastic cap that is coupled to the cover member 210 so that it forms an integral part of the closure member 200. The cap member 230 comprises a top portion 231 that is bonded to the inner surface of the top portion 211 of the cover member 210, a sidewall portion 232 extending downwardly from the top portion 231, and a flange portion 233 extending downwardly and outwardly from the sidewall portion 232 to a distal end 234 of the cap member 230. The top portion 231 is a flat, planar portion in the exemplified embodiment and it includes an upper surface 235 that faces the cover member 210 and a lower surface 236 opposite the upper surface 235. The cap member 230 is positioned so that the upper surface 235 thereof is in contact with the inner surface of the top portion 221 of the cover member 210. The plastic layer 222 comprises the portion of the inner surface of the top portion 211 that is in contact with the upper surface 235 of the cap member 230. Therefore, the cap member 230 is coupled to the cover member 210 via plastic welding, which causes the plastic material of the cap member 230 to become attached to the plastic layer 222 of the cover member 210, which thereby couples the cap member 230 to the cover member 210. In the exemplified embodiment, the top portion 231 of the cap member 230 comprises a central aperture 237 that extends from the upper surface 235 to the lower surface 236. However, the central aperture 237 could be omitted in other embodiments.

The sidewall portion 232 of the cap member 230 comprises an inner surface 238 and an outer surface 239. The flange portion 233 of the cap member 230 comprises an inner surface 240 that is continuous with the inner surface 238 of the sidewall portion 232 and an outer surface 241 that is continuous with the outer surface 239 of the sidewall portion 232. The inner surfaces 238, 240 of the sidewall portion 232 and the flange portion 233 in combination with the lower surface 236 of the top portion 231 of the cap member 230 collectively define a cap cavity 242. The cap cavity 242 comprises a second longitudinal axis B-B which extends in a direction from the distal end 234 of the cap member 230 towards the top portion 231 of the cap member 230.

The outer surfaces 239, 241 of the sidewall and flange portions 232, 233 of the cap member 230 are spaced apart from the inner surface 215 of the sidewall portion 212 of the cover member 210. Moreover, the distal end 234 of the cap member 230 is recessed relative to the distal end 218 of the sidewall portion 212 of the cover member 210. Thus, the cap member 230 is positioned entirely within the cover cavity 217 in the exemplified embodiment. That is, the cap member 230 does not protrude beyond the distal end 218 of the sidewall portion 212 of the cover member 210 of the closure component 200 in the exemplified embodiment. The cap member 230 is located centrally along the top portion 211 of the cover member 210 in the exemplified embodiment.

The sidewall portion 232 of the cap member 230 is tapered as it extends in a direction from the flange portion 233 towards the top portion 231. That is, the cross-sectional area of the cap cavity 242 decreases with increasing distance away from the distal end 234 of the cap member 230 towards the top portion 231 of the cap member 230. In the exemplified embodiment, the sidewall portion 232 is a 6% taper, such that each side of the sidewall 232 as seen in longitudinal cross-section in FIG. 3 is oriented at a second taper angle $\Theta 2$ relative to the second longitudinal axis B-B. The second taper angle $\Theta 2$ is approximately 1.72° in the exemplified embodiment (as noted above, a slope with rise over run percentage of 6% converted to degrees is 3.43 degrees, which divided in half for each side of the sidewall portion 232 is 1.715° (which rounds up to 1.72°). The 6% taper of the sidewall 232 portion 232 of the cap member 230 matches the 6% taper of the sidewall portion 155 of the nozzle 150 so that when the cap member 230 is coupled to the nozzle 150, a tight and secure friction fit is achieved via a Luer-slip design.

The cap member 230 comprises one or more ribs 245 located adjacent to the lower surface 236 of the top portion 231. The one or more ribs 245 may be coupled to the top portion 231, to the sidewall portion 232, or both. In the exemplified embodiment, there are three of the ribs 245, although only two are shown in the drawings in FIG. 3. There may be more or less than three of the ribs 245 in other embodiments. The ribs 245 prevent the closure component 200 from being pushed too far onto the tube assembly 100 when the closure component 200 is being altered from the detached state to the attached state. Specifically, the ribs 245 maintain a gap between the distal end (151 or 157) of the nozzle 150 and the top portion 231 of the cap member 230 of the closure component 200, as best seen in FIG. 6B.

Figure 6A:
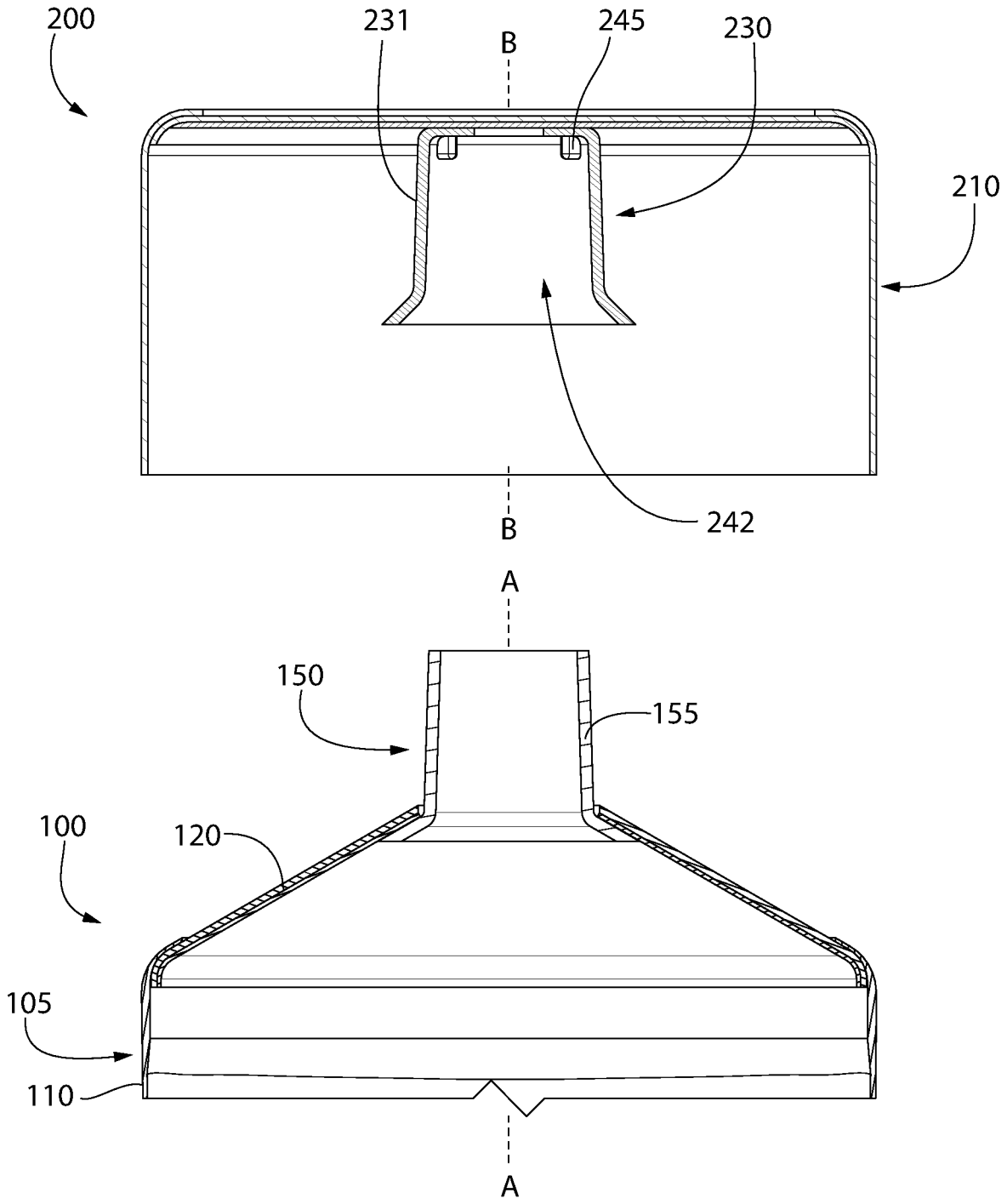
FIG. 6A is a cross-sectional view illustrating the closure component aligned with the body and nozzle in preparation for coupling the closure component to the body and/or nozzle.
Figure 6B:
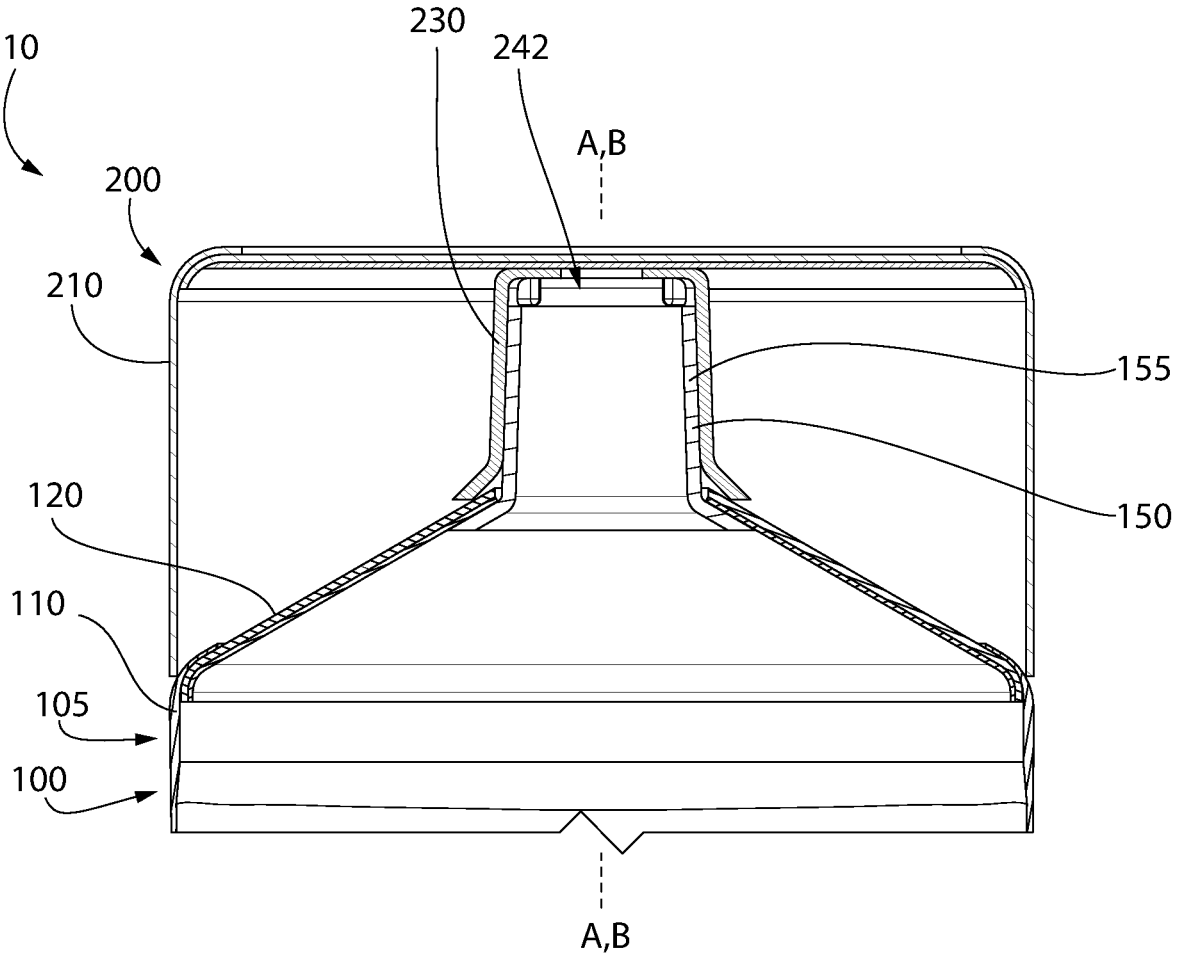
FIG. 6B is a cross-sectional view taken along line VIB-VIB of FIG. 1 illustrating the closure component coupled to the nozzle.

Referring to FIGS. 6A and 6B, the altering of the closure component 200 from the detached state (FIG. 6A) to the attached state (FIG. 6B) will be described. In FIG. 6A, the closure component 200 is maintained above the tube assembly 100 with the second longitudinal axis B-B of the cap cavity 242 coincident with the first longitudinal axis A-A of the body 105 (or of the tube assembly 100). The sidewall portion 155 of the nozzle 150 and the sidewall portion 232 of the cap member 230 are both tapered moving in in upward axial direction. This ensures an appropriate tight friction fit is achieved between the nozzle 150 and the cap member 230 when the closure component 200 is altered into the attached state. As noted above, the nozzle 150 forms a male part or fitting of a Luer-slip connection and the cap member 230 (or the cap cavity 242 thereof) forms a female part or fitting of a Luer-slip connection. Thus, the nozzle 150 and cap member 230 can be coupled together by pressing them together, whereby they are held by friction. Thus, to attach the closure component 200 to the tube assembly 100, a user simply presses the closure component 200 axially onto the tube assembly 100 and to detach the closure component 200 from the tube assembly 100, a user simply pulls the closure component 200 axially away from the tube assembly 100 while holding the tube assembly 100 still or pulling the tube assembly 100 in the opposite axial direction. The user may incorporate a twisting motion onto the closure member 200 relative to the tube assembly 100 to help with the detachment of the closure member 200 if needed (i.e., if the friction fit between the nozzle 150 and the cap member 230 is so tight that a simply pulling force does not readily separate the closure member 200 from the tube assembly 100). The nozzle 150 and cap member 230 are free of threads or other components which may lock the nozzle 150 and the cap member 230.

FIG. 6B illustrates the closure component 200 in the attached state, whereby the nozzle 150 and the cap member 230 interact to seal the open top end 102 of the tube assembly 100 (which is formed by the first end 151 of the nozzle 150). As can be seen, when the closure member 200 is translated axially towards the tube assembly 100, the first end 151 of the nozzle 150 enters into the cap cavity 242. The closure member 200 is continued to be pressed towards the tube assembly 100 until the first end 151 of the nozzle 150 abuts against the ribs 245 of the closure member 200. As discussed above, this type of attachment is known as a Luer-slip or slip-tip and it is achieved solely due to the particular taper of the sidewall 155 of the nozzle 150 and the sidewall 231 of the cap member 230 discussed above. This taper angle creates a scal that prevents leaking of the substance contained in the internal cavity 113 of the tube assembly 100. The friction fit between the sidewall 155 of the nozzle 150 and the sidewall 231 of the cap member 230 is all that is used and required to maintain the closure component 200 in the attached state. When the closure member 200 is in the attached state, the sidewall portion 155 of the nozzle 150 nests within the cap cavity 242 of the cap member 230 of the closure component 200.

As noted above, the nozzle 150 and the cap member 230 are the only two parts that are formed from plastic. Everything else, including the body 105 (main body component 110 and shoulder component 120) and the cover member 210 of the closure component 200 is formed from a fibrous material such as paper or the like. Of course, there may be some layers of plastic on parts of the body 105 and/or cover member 210 in some embodiments for purposes of attaching the nozzle 150 to the body 105 and for purposes of attaching the cap member 230 to the cover member 210. However, in total, the squeezable tube dispenser 10 comprises no more than 15% by weight of plastic, with the rest of the wt % of the squeezable tube dispenser 10 being formed from a fibrous material. In some embodiments, the squeezable tube dispenser 10 may comprise no more than 10% by weight of plastic, with the rest of the wt % of the squeezable tube dispenser 10 being formed from a fibrous material. As a result, the squeezable tube dispenser 10 is able to be recycled in the paper waste stream, which has environmental advantages when compared in particular to packages formed from plastic.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A squeezable tube dispenser comprising:

a body comprising an interior cavity for containing a substance, a sealed bottom end, and an open top end;

a nozzle coupled to the body adjacent to the open top end of the body, the nozzle defining a passageway into the internal cavity; and a closure component comprising:

a cover member having a top portion and a sidewall portion, an inner surface of the top portion and an inner surface of the sidewall portion defining a cover cavity; and a cap member coupled to the inner surface of the top portion of the cover member and protruding downwardly therefrom into the cover cavity, the cap member comprising an inner surface that defines a cap cavity;

wherein the cap member of the closure component is detachably coupled to the nozzle via a friction fit with the nozzle nesting within the cap cavity of the cap member; and wherein the body and the cover member of the closure component are formed predominantly from a fibrous material and the nozzle and the cap of the closure component are formed from a plastic material, and wherein the squeezable tube dispenser comprises no more than 15% by weight of plastic.

2. The squeezable tube dispenser according to claim 1 wherein the body comprises a main body component and a shoulder component that are coupled together.

3. The squeezable tube dispenser according to claim 1 wherein the body comprises a fibrous portion having an inner surface that faces the internal cavity and an outer surface that faces away from the internal cavity, a top portion of the body adjacent to the open top end comprising a plastic layer covering the inner surface of the fibrous portion, and wherein the nozzle comprises a sidewall portion and a flange portion extending from the sidewall portion, the flange portion of the nozzle being located within the internal cavity of the body and bonded to the plastic layer of the body.

4. The squeezable tube dispenser according to claim 1 wherein the nozzle comprises a sidewall that extends from the open top end of the body and terminates at a distal end, the sidewall being tapered as the sidewall extends from the open top end of the body towards the distal end, and wherein the cap member of the closure component comprises a sidewall that extends from the inner surface of the top portion of the cover member, the sidewall of the cap member being tapered in a direction towards the top portion of the cover member.

5. The squeezable tube dispenser according to claim 4 wherein the body comprises a first longitudinal axis and wherein the sidewall of the nozzle has a first taper angle relative to the first longitudinal axis, and wherein the cap cavity comprises a second longitudinal axis and the sidewall of the cap member of the closure component has a second taper angle relative to the second longitudinal axis, the first and second taper angles being the same, and the first and second longitudinal axes being coincident when the closure member is coupled to the nozzle.

6. The squeezable tube dispenser according to claim 5 wherein the first and second taper angles are 1.72° and wherein each of the sidewall of the nozzle and the sidewall of the cap member has a 6% taper.

7. The squeezable tube dispenser according to claim 1 wherein the cap member of the closure component comprises a top portion that is bonded to the inner surface of the top portion of the cover member of the closure component, a sidewall portion extending downwardly from the top portion, and a flange portion extending downwardly and outwardly from the sidewall portion to a distal end of the cap member, the distal end of the cap member being located within the cover cavity.

8. The squeezable tube dispenser according to claim 7 wherein the sidewall portion of the cover member of the closure component terminates in a distal end, and wherein the distal end of the cap member is recessed relative to the distal end of the sidewall portion of the cover member.

9. The squeezable tube dispenser according to claim 7 further comprising one or more ribs extending from at least one of the top portion of the cap member and the sidewall portion of the cap member, and wherein when the closure component is coupled to the nozzle a distal end of the nozzle abuts against the one or more ribs to maintain a gap between the top portion of the cap member and the distal end of the nozzle.

10. The squeezable tube dispenser according to claim 1 wherein the top portion of the cover member comprises a fibrous portion having an inner surface that faces the cover cavity and a plastic portion that covers at least a portion of the inner surface of the fibrous portion, and wherein the cap member is bonded to the plastic portion of the top portion of the cover member.

11. The squeezable tube dispenser according to claim 1 wherein the nozzle and the cap member of the closure component are free of threads such that the closure component is coupled to the nozzle solely due to a friction fit engagement between the cap member and the nozzle.

12. The squeezable tube dispenser according to claim 10 wherein the nozzle and the cap member of the closure component are detachably coupled together solely via a Luer-slip engagement.

13. The squeezable tube dispenser according to claim 1 wherein the cover member of the closure component is not directly attached to the nozzle or the body, a distal end of the cover member being adjacent to an outer surface of the body when the closure component is coupled to the nozzle.

14. The squeezable tube dispenser according to claim 1 wherein the cap member of the closure component comprises a top portion that is bonded to the inner surface of the top portion of the cover member, the top portion of the cap member comprising a central aperture.

15. The squeezable tube dispenser according to claim 1 wherein an entirety of the cap member is located within the cover cavity.

16. The squeezable tube dispenser according to claim 1 wherein the detachable coupling between the cap member and the nozzle is a Luer-slip coupling.

17. The squeezable tube dispenser according to claim 1 wherein the squeezable tube dispenser comprises no more than 10% by weight of plastic.

18. A squeezable tube dispenser comprising:

a body comprising an interior cavity for containing a substance;

a nozzle coupled to the body and defining a passageway into the internal cavity through which the substance is configured to be dispensed; and a closure component comprising:

a cover member defining a cover cavity; and a cap member coupled to the cover member and protruding into the cover cavity, the cap member comprising an inner surface that defines a cap cavity;

wherein the cap member and the nozzle have tapered sidewalls so that the cap member is detachably coupled to the nozzle via a Luer-slip connection with the nozzle nesting within the cap cavity of the cap member; and wherein the body and the cover member are formed predominantly from a fibrous material and the nozzle and the cap are formed from a plastic material, and wherein the squeezable tube dispenser comprises no more than 15% by weight of plastic.

19. The squeezable tube dispenser according to claim 18 wherein the squeezable tube dispenser comprises no more than 10% by weight of plastic.

* * * * *